US009582964B2

(12) United States Patent
Plowman

(10) Patent No.: US 9,582,964 B2
(45) **Date of Patent: *Feb. 28, 2017**

(54) APPARATUS, SYSTEM AND METHOD FOR AWARDING PROGRESSIVE OR JACKPOT PRIZES

(71) Applicant: Aristocrat Technologies Australia Pty Limited, North Ryde (AU)

(72) Inventor: Gregory Leigh Plowman, Lane Cove (AU)

(73) Assignee: ARISTOCRAT TECHNOLOGIES AUSTRALIA PTY LTD (AU)

( * ) Notice: Subject to any disclaimer, the term of this patent is extended or adjusted under 35 U.S.C. 154(b) by 0 days.

This patent is subject to a terminal disclaimer.

(21) Appl. No.: 15/019,805

(22) Filed: Feb. 9, 2016

(65) Prior Publication Data

US 2016/0163155 A1 Jun. 9, 2016

Related U.S. Application Data

(63) Continuation of application No. 11/851,124, filed on Sep. 6, 2007, now Pat. No. 9,257,008.

(60) Provisional application No. 60/843,313, filed on Sep. 8, 2006.

(51) Int. Cl.
*G07F 17/32* (2006.01)
*G07F 17/34* (2006.01)

(52) U.S. Cl.
CPC ..... *G07F 17/3258* (2013.01); *G07F 17/32* (2013.01); *G07F 17/3209* (2013.01); *G07F 17/3223* (2013.01); *G07F 17/3246* (2013.01); *G07F 17/34* (2013.01)

(58) Field of Classification Search
CPC ... G07F 17/32; G07F 17/3244; G07F 17/3258
See application file for complete search history.

(56) References Cited

U.S. PATENT DOCUMENTS

| | | | |
|---|---|---|---|
| 5,116,055 | A | 5/1992 | Tracy |
| 5,275,400 | A | 1/1994 | Weingardt et al. |
| 5,839,731 | A | 11/1998 | Feola |
| 6,017,032 | A | 1/2000 | Grippo et al. |
| 6,935,948 | B2 | 8/2005 | Wright |
| 7,297,059 | B2 | 11/2007 | Vancura et al. |
| 7,357,716 | B2 | 4/2008 | Marks et al. |
| 7,578,739 | B2 | 8/2009 | Gauselmann |
| 7,604,540 | B2 | 10/2009 | Olive |
| 2005/0055113 | A1 | 3/2005 | Gauselmann |
| 2005/0239542 | A1 | 10/2005 | Olsen |

(Continued)

FOREIGN PATENT DOCUMENTS

WO 03/063019 7/2003

OTHER PUBLICATIONS

Examiner's first report on Australian Patent Application Serial No. 2007216689, dated Jun. 23, 2009.

*Primary Examiner* — Dmitry Suhol
*Assistant Examiner* — David Duffy
(74) *Attorney, Agent, or Firm* — McAndrews, Held & Malloy, Ltd.

(57) ABSTRACT

Gaming methods and apparatus are described for providing a plurality of progressive prizes for a gaming system. Separate progressive prizes are maintained for each of a plurality of different wager options for a game playable on the gaming system. The progressive prizes can be maintained so as to reduce the difference in contribution to the expected return to player between the wager options.

6 Claims, 6 Drawing Sheets

(56) References Cited

U.S. PATENT DOCUMENTS

| | | | |
|---|---|---|---|
| 2006/0154718 | A1 | 7/2006 | Willyard et al. |
| 2006/0166735 | A1 | 7/2006 | Steil et al. |
| 2009/0131159 | A1 | 5/2009 | Englman et al. |
| 2009/0275398 | A1 | 11/2009 | Nelson |
| 2009/0275400 | A1 | 11/2009 | Rehm et al. |
| 2009/0298574 | A1 | 12/2009 | Gauselmann |
| 2009/0305777 | A1 | 12/2009 | Anderson |
| 2010/0093420 | A1 | 4/2010 | Wright et al. |

| | |
|---|---|
| 1 credit jackpot | $128.24 |
| 2 credit jackpot | $255.16 |
| 3 credit jackpot | $388.68 |
| 5 credit jackpot | $645.54 |
| 10 credit jackpot | $1281.66 |

Figure 7

| | |
|---|---|
| 1 credit jackpot | $128.24 |
| 2 credit jackpot | $255.16 |
| 3 credit jackpot | $388.68 |
| 5 credit jackpot | $645.54 |
| 10 credit jackpot | $1281.66 |

Figure 8

APPARATUS, SYSTEM AND METHOD FOR AWARDING PROGRESSIVE OR JACKPOT PRIZES

CROSS REFERENCE TO RELATED APPLICATIONS

This application claims priority to U.S. patent application Ser. No. 11/855,124, now U.S. Pat. No. 9,257,008, filed on Sep. 6, 2007, which claims priority to U.S. Provisional Application No. 60/843,313, having a filing date of Sep. 8, 2006, entitled "Apparatus, System and Method for Awarding Progressive or Jackpot Prizes."

FIELD OF THE INVENTION

The present invention generally relates to gaming apparatus and methods of gaming in which a wager is placed on one or more outcomes and a prize is won if a particular outcome results. A particular embodiment of the present invention relates to gaming apparatus and methods of gaming that award a progressive or jackpot prize.

BACKGROUND OF THE INVENTION

With the increase of gambling at gaming venues has come increased competition between gaming venues to obtain a larger share of the total gambling spend. Gaming venue operators have therefore continuously looked for new variations and types of games in order to attract both new and return customers to their venues.

In response to this need, suppliers of gaming devices and systems have attempted to provide the sought after variety, while still developing games that comply with the relevant regulations in the jurisdiction of the gaming venue operator. Suppliers of gaming devices therefore are faced with restrictions on the types of games and gaming apparatus that are allowable, both in terms of the prevailing regulations and in terms of providing a return on investment to the gaming venue operators.

In addition, it is important that a player be able to understand the operation of a game quickly so that the player can start to quickly play the game and therefore extract maximum entertainment from the game.

One method that has been used with gaming machines is to offer a progressive prize. The progressive prize is contributed to through gaming activity on the gaming machine, for example by taking a percentage of all wagers placed on the gaming machine. The progressive prize is awarded on the occurrence of a progressive prize winning event. Various methods of contribution to a progressive prize and determination of when the progressive prize has been awarded have been developed.

A problem with progressive prizes is finding an appropriate method of determining how to award the progressive prize. Taking the example of a gaming machine that implements a spinning reel game, if the progressive prize winning event is the spinning up of a particular combination of symbols on a pay line that has been purchased through the placing of a wager in the form of a number of credits, then this combination can be expected to occur with the same frequency no matter how many credits are wagered on that outcome.

For other winning combinations of a pay line, the award may be multiplied by the amount of credits that were wagered on that pay line. However, multiplication of a progressive prize in this manner is not viable. The result is that the contribution to the expected return to player of the progressive prize is higher for players that only wager a single credit per pay line than for players that wager multiple credits per pay line. An ongoing problem faced in the field is how to develop new ways of offering progressive prizes that adequately address variations in the expected return to player.

SUMMARY OF THE INVENTION

According to a first aspect, the invention broadly resides in a method of providing a game on a gaming system, the method comprising controlling the gaming system to provide a game in which:

a plurality of progressive prizes are able to be won, the progressive prizes being contributed to through placing wagers in the game;

a game play of the game comprises presenting at least one symbol on a display to form at least one outcome from a plurality of possible outcomes comprising a progressive winning outcome;

one of the plurality of progressive prizes is awarded on the occurrence of a progressive winning outcome in a game play of the game; and a plurality of different wager options can be made on the at least one outcome, the wager options comprising n distinct wager options for which the probability of occurrence of the progressive winning outcome per unit wager is different;

wherein n is at least two and each of the n distinct wager options is associated with one of the progressive prizes, and wherein when the progressive winning outcome occurs in a game play, the method comprises awarding the progressive prize associated with the wager option made in that game play.

In one embodiment, the method may comprise forming a plurality of progressive pools, there being at least as many progressive pools as there are progressive prizes, each wager option being associated with at least one progressive pool and at least one wager option being associated with at least two progressive pools, the method further comprising contributing to each of the progressive pools associated with a wager option when that wager option is made in the game, the progressive prize associated with a wager option being the sum of the progressive pools that are contributed to when that wager option is made. The progressive pools contributed to when a wager option is made may comprise all the progressive pools contributed to by a wager option having a higher probability of occurrence of the progressive winning outcome per unit wager.

In one embodiment, the game may have a single progressive winning outcome. The probability of occurrence of the progressive winning outcome may be the same for each said game play, regardless of which of the n distinct wager options is made.

In one embodiment, at least one wager option can be made in the game by a player of the game by making two different value wagers. The method may comprise contributing to the progressive prizes as a whole in proportion to the value of the wager.

According to a second aspect, the invention broadly resides in a method of providing a plurality of progressive prizes for a gaming system, the method comprising maintaining a separate progressive prize for each of a plurality of different wager options for a game playable on the gaming system, each said wager option resulting in a different contribution to the expected return to player of the game if a single progressive prize was maintained for all of the wager options, and maintaining the progressive prizes so as to reduce the difference in contribution to the expected return to player between the wager options.

In one embodiment, the method may comprise forming a plurality of progressive pools, there being at least as many progressive pools as there are progressive prizes, each wager option being associated with at least one progressive pool and at least one wager option being associated with at least two progressive pools, the method further comprising contributing to each of the progressive pools associated with a wager option when that wager option is made in the game, the progressive prize for a wager option being the sum of the progressive pools that are contributed to when that wager option is made. The progressive pools contributed to when a wager option is made may comprise all the progressive pools contributed to by a wager option having a higher probability of occurrence of the progressive winning outcome per unit wager.

According to a third aspect, the invention broadly resides in a gaming system comprising at least one gaming machine, each gaming machine providing a game in which a plurality of symbols are presented on a display and if a winning combination occurs in the presented plurality of symbols, the gaming machine awards an award, the gaming system comprising an electronic processing system comprising one or more game controllers operable to:

maintain a plurality of progressive prizes that can be won through play of any one of the gaming machines, and contribute to the progressive prizes dependent on said play, wherein a plurality of different wager options can be made at the gaming machines, the wager options comprising n distinct wager options for which the probability of winning a progressive prize is different, resulting in differences in the return to player between the wager options, and associating each wager option with one of the progressive prizes;

monitor for the occurrence of a progressive winning outcome, and on the occurrence of the progressive winning outcome, associate that occurrence of the progressive winning outcome with the making of one of said wager options and pay the progressive prize associated with that wager option; and maintain the progressive prizes so as to reduce the differences in the expected return to player between the wager options.

In one embodiment, the gaming system may comprise a plurality of gaming machines, each of which contribute to the progressive prizes and win one of the progressive prizes on the occurrence of a progressive winning outcome.

According to a fourth aspect, the invention broadly resides in a method of providing a game on a gaming system, the method comprising controlling the gaming system to provide a game in which:

a plurality of jackpot prizes are able to be won;

a game play of the game comprises presenting at least one symbol on a display to form at least one outcome from a plurality of possible outcomes comprising a jackpot winning outcome;

one of the plurality of jackpot prizes is awarded on the occurrence the jackpot winning outcome in a game play of the game; and a plurality of different wager options can be made on the at least one outcome, the wager options comprising n distinct wager options for which the probability of occurrence of the jackpot winning outcome per unit wager is different;

wherein n is at least two and each of the n distinct wager options is associated with one of the jackpot prizes, and wherein when the jackpot winning outcome occurs in a game play, the method comprises awarding the jackpot prize associated with the wager option made in that game play.

In one embodiment, at least one of the wager options may be associated with a plurality of different wager values.

According to a fifth aspect, the invention broadly resides in a method of providing a plurality of jackpot prizes for a gaming system, the method comprising offering a separate jackpot prize for each of a plurality of different wager options for a game playable on the gaming system, each said wager option resulting in a different contribution to the expected return to player of the game if a single jackpot prize was maintained for all of the wager options, and setting the jackpot prizes so as to have respective values that reduce the difference in contribution to the expected return to player between the wager options.

In one embodiment, at least one of the wager options is associated with a plurality of different wager values.

According to a sixth aspect, the invention broadly resides in a gaming system comprising at least one gaming machine, each gaming machine providing a game in which a plurality of symbols are presented on a display and if a winning combination occurs in the presented plurality of symbols, the gaming machine awards an award, the gaming system comprising an electronic processing system comprising one or more game controllers operable to:

maintain a plurality of jackpot prizes that can be won through play of any one of the gaming machines, and contribute to the jackpot prizes dependent on said play, wherein a plurality of different wager options can be made at the gaming machines, the wager options comprising n distinct wager options for which the probability of winning a jackpot prize is different, resulting in differences in the return to player between the wager options, and associating each wager option with one of the jackpot prizes;

monitor for the occurrence of a jackpot winning outcome, and on the occurrence of the jackpot winning outcome, associate that occurrence of the jackpot winning outcome with the making of one of said wager options and pay the jackpot prize associated with that wager option; and assigning values to the jackpot prizes so as to reduce the differences in the expected return to player between the wager options.

In one embodiment, at least one of the wager options may be associated with a plurality of different wager values.

According to a seventh aspect, the invention broadly resides in a method of providing a plurality of progressive prizes for a gaming system comprising a gaming machine, the method comprising maintaining at least three progressive prize pools that form at least two progressive prizes and for at least one wager made on the gaming machine increasing at least two, but less than all of the progressive prize pools. At least r progressive prize pools may be maintained that combine to form between 2 and r−1 progressive prizes, wherein r is greater than or equal to 3.

In one embodiment, the gaming system comprises a plurality of linked gaming machines, the method including for at least one wager made on each of the gaming machines increasing at least two, but less than all of the progressive prize pools.

In one embodiment, the method may further comprise providing a chance to win a progressive prize in response to the at least one wager, the progressive prize formed from the progressive pools that are contributed to when that wager is made.

In one embodiment, at least one of the progressive prizes may be formed as a sum of a plurality of said progressive pools.

In one embodiment, a player can wager a plurality of different amounts on each outcome on the gaming machine and the method may further comprise forming a number of progressive prizes equal to the number of distinct wager amounts.

In one embodiment, each progressive prize is associated with a particular wager option on the gaming machine and can only be won if that wager option is played, wherein each wager option results in an increase of the progressive prize associated with that wager option and every wager option that has a lower value per game outcome than that wager option.

According to an eight aspect, the invention broadly resides in a gaming system comprising at least one gaming machine, each gaming machine providing a game in which a plurality of symbols are presented on a display and if a winning combination occurs in the presented plurality of symbols, the gaming machine awards an award, the gaming system comprising an electronic processing system comprising one or more game controllers operable to:

monitor game play at a said gaming machine, including determining which one of a plurality of different wager options has been selected in the game play;

maintain at least three prize pools and from the prize pools form a plurality of progressive prizes that can be won through play of a said gaming machine;

monitor for the occurrence of a progressive winning outcome in said game play, and on the occurrence of the progressive winning outcome paying the progressive prize associated with that wager option; and when it is determined that at least one of said wager options has been selected in a monitored game play, increasing at least two, but less than all of the progressive prize pools.

In one embodiment, the at least one progressive prize may be formed by the sum of a plurality of prize pools. There may be more prize pools than progressive prizes formed from the prize pools.

In one embodiment, the gaming system may further comprise at least one display on which the values of the progressive prizes are displayed. The values of the progressive prizes may be displayed on at least two displays, a first display located at a said gaming machine and a second display located remote from the gaming machine. The progressive winning outcome may result in the award of one of the progressive prizes, the progressive prize being awarded being dependent on the wager option selected for the game play associated with the progressive winning outcome and the first display may display only the value of the progressive prize that is able to won in a game play in a current or immediately preceding game play and the second display may display the value of all of the progressive prizes.

According to a ninth aspect, the invention broadly resides in a method of providing a plurality of progressive prizes for a gaming system comprising a gaming machine which provides a game in which a plurality of wager options are available to be selected, the method comprising maintaining a progressive prize associated with each of the wager options, the method comprising incrementing the value of each of the progressive prizes by varying relative amounts dependent on the wager option selected.

In one embodiment, if the wager option that results in the smallest wager or wagers being placed is selected, then all progressive prizes are incremented by the same amount.

In one embodiment, if the wager option that results in the largest wager or wagers being made is selected, then every progressive prize is incremented by a different amount. Each progressive prize may be incremented by a multiple of a common value, the common value determined dependent on the size of the wager.

In one embodiment, there may be at least three said wager options having different values ranging from a minimum value to a maximum value, and at least three said progressive prizes and each wager option is associated with one of the progressive prizes and wherein on the placing of a wager according to a wager option causes the progressive prize associated with that wager option and each progressive prize associated with each wager option having a higher value to be increased by the same amount and each the progressive prize associated with a wager option having a lower value to be increased by a lesser amount. The increase of the wager options having a lower value may reduce with a reduction in wager value. The reduction in the increase of the wager options having a lower value may increase proportional to the relative values of the wager options.

According to a tenth aspect, the invention broadly resides in a gaming system comprising at least one gaming machine, each gaming machine providing a game in which a plurality of symbols are presented on a display and if a winning combination occurs in the presented plurality of symbols, the gaming machine awards an award, the gaming system comprising an electronic processing system comprising one or more game controllers operable to:

monitor game play at a said gaming machine, including determining which one of a plurality of different wager options has been selected in the game play;

maintain a plurality of progressive prizes that can be won through play of a said gaming machine, each progressive prize being associated with a different one of the wager options;

monitor for the occurrence of a progressive winning outcome in said game play, and on the occurrence of the progressive winning outcome paying the progressive prize associated with that wager option; and when it is determined that at least one of said wager options has been selected in a monitored game play, increasing the value of the progressive prizes by varying relative amounts, the variation being dependent on the wager option selected.

In one embodiment, there are at least three said wager options having different values ranging from a minimum value to a maximum value, and at least three said progressive prizes associated with the progressive prizes and wherein the electronic processing system detects the placing of a wager according to a wager option and in response causes the progressive prize associated with that wager option and each progressive prize associated with each wager option having a higher value to be increased by the same amount and each the progressive prize associated with a wager option having a lower value to be increased by a lesser amount According to an eleventh aspect, the invention broadly resides in a method of providing a plurality of progressive prizes for a gaming system comprising a gaming machine which provides a game in which a plurality of wager options are available to be selected, the method comprising maintaining a progressive prize associated with each of the wager options, and contributing to the progressive prizes in proportion to the value of a wager placed in a game play of the game, wherein the proportional allocation of the wager to at least one of the progressive prizes varies depending on the wager option selected.

In one embodiment, the total proportional contribution to the plurality of wager options may remain constant regardless of which wager option is selected.

In one embodiment, the proportional allocation of the wager to the progressive prize associated with a first said wager option may be at a first level when a wager is made using that wager option and using a wager option with a lesser value, and at a second level, less than the first level if a wager is made using a wager option of a higher value. The game may be a spinning reel game and the wager options may represent different values of wager per line in the spinning reel game.

According to a twelfth aspect, the invention broadly resides in a gaming system comprising at least one gaming machine, each gaming machine providing a game in which a plurality of symbols are presented on a display and if a winning combination occurs in the presented plurality of symbols, the gaming machine awards an award, the gaming system comprising an electronic processing system comprising one or more game controllers operable to:

monitor game play at a said gaming machine, including determining which one of a plurality of different wager options has been selected in the game play;

maintain a plurality of progressive prizes that can be won through play of a said gaming machine, each progressive prize being associated with a different one of the wager options;

monitor for the occurrence of a progressive winning outcome in said game play, and on the occurrence of the progressive winning outcome paying the progressive prize associated with that wager option; and contributing to the progressive prizes in proportion to the value of a wager placed in a game play of the game, the proportional allocation of the wager to at least one of the progressive prizes varies depending on the wager option selected.

According to a thirteenth aspect of the present invention, there is provided a method of establishing a gaming system comprising a plurality of linked gaming machines each of which provide a game in which a player may stake a wager on an outcome of the game comprising a winning outcome, the gaming system awarding a progressive or jackpot prize on the occurrence of a progressive or jackpot winning outcome during game play of the game on any one of the gaming machines, wherein the probability of occurrence of the progressive or jackpot winning outcome is independent of the wager that is placed on that outcome being a winning outcome, the method comprising:

identifying the highest value wager that may be placed on any one of the outcomes on any of the plurality of linked gaming machines;

identifying a common divisor of all of the wagers that may placed on any one of the outcomes on any of the plurality of linked gaming machines;

creating p pools, wherein p is the quotient of the identified highest value wager and the common divisor;

establishing a progressive for each of the identified distinct wager options, wherein a said wager option is a wager that is placed on a said outcome being a winning outcome, wherein the value of each progressive prize is the sum of s pools, wherein s is the quotient of the value of the wager option and the common divisor and wherein the sum of s pools for progressive prizes established for higher value wager options includes all of the pools used to determine the value of each lower value wager option plus at least one additional pool;

wherein the value of the jackpot or progressive prize is dependent on the progressive established for the wager option that was placed when the progressive or jackpot winning outcome occurred.

According to a fourteenth aspect of the present invention, there is provided a gaming system when established according to the method described in the preceding paragraph.

According to a fifteenth aspect of the present invention, there is provided computer readable storage storing instructions that when executed cause a gaming system to implement any of the methods described in the immediately preceding paragraphs.

Further aspects of the present invention and further embodiments of the aspects described above will become apparent from the following description, given by way of example only and with reference to the accompanying drawings.

BRIEF DESCRIPTION OF THE DRAWINGS

The present invention will now be described, by way of example only, with reference to the accompanying drawings, in which:

FIG. 7: shows a first simplified screen display showing jackpot prize values displayed by a gaming system in accordance with an embodiment of the present invention.

FIG. 8: shows a second simplified screen display showing jackpot prize values displayed by a gaming system in accordance with an embodiment of the present invention.

DETAILED DESCRIPTION

Figure 1:
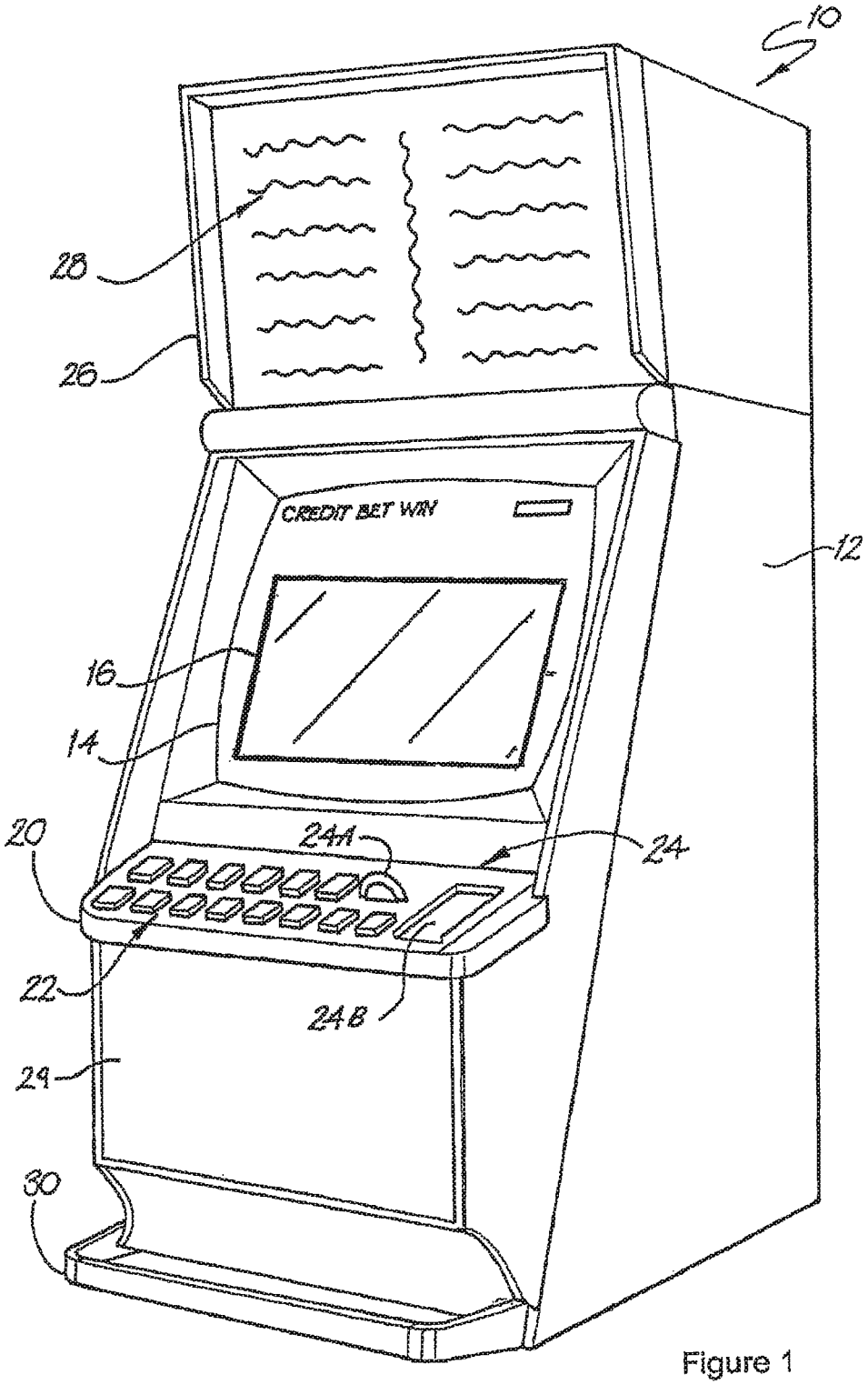
FIG. 1: shows diagrammatically, a view of a gaming machine suitable for implementing certain embodiments of the invention.

In FIG. 1 of the accompanying drawings, one example of a gaming machine suitable for implementing certain embodiments of the present invention is generally referenced by arrow 10.

The gaming machine 10 includes a console 12 having a display 14 on which is displayed representations of a game 16, that can be played by a player. A mid-trim 20 of the gaming machine 10 houses a bank of buttons 22 for enabling a player to play the game 16. The mid-trim 20 also houses a credit input mechanism 24 including a coin input chute 24A and a bill collector 24B. A top box 26 may carry artwork 28, including for example, pay tables and details of bonus awards and other information or images relating to the game. Further artwork and/or information may be provided on the front panel 29 of the console 12. A coin tray 30 is mounted beneath the console 12 for cash payouts from the gaming machine 10.

The display 14 shown in FIG. 1 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or a different type of display.

Figure 2:
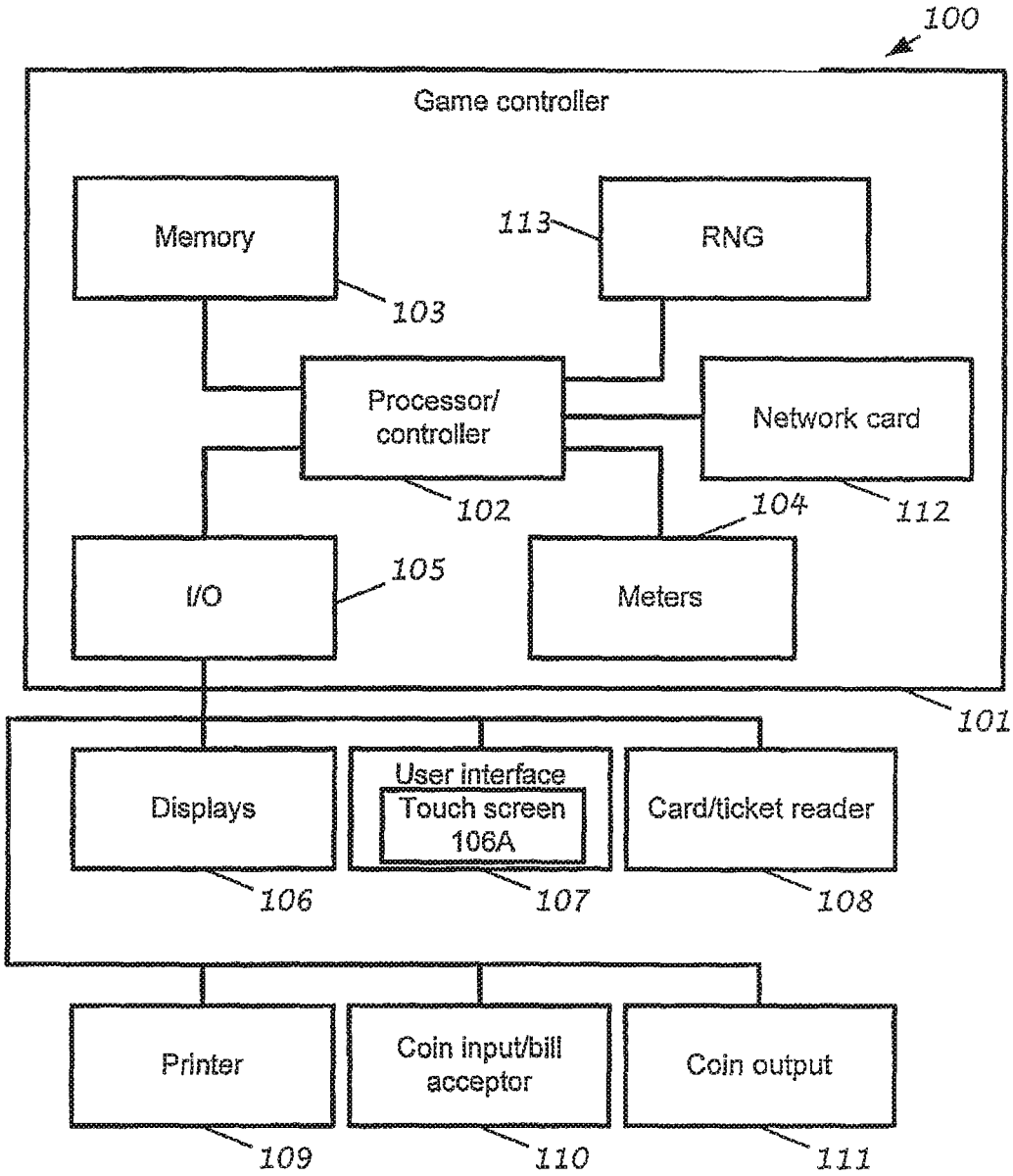
FIG. 2: shows a block diagram of gaming apparatus suitable for implementing certain embodiments of the invention.

FIG. 2 shows a block diagram of a gaming apparatus, generally referenced by arrow 100, suitable for implementing certain embodiments of the present invention. The gaming apparatus 100 may, for example, operate as a standalone gaming machine of the type shown in FIG. 1. However, the gaming apparatus 100 may alternatively operate as a networked gaming machine, communicating with other network devices, such as one or more servers or other gaming machines. The gaming apparatus 100 may also have distributed hardware and software components that communicate with each other directly or through a network. Accordingly, different reference numerals have been used in FIG. 2 from FIG. 1 for components that may be equivalent.

The gaming apparatus 100 includes a game controller 101, which in the illustrated example includes a computational device 102, which may be a microprocessor, microcontroller, programmable logic device or other suitable device. Instructions and data to control operation of the computational device 102 are stored in a memory 103, which is in data communication with or forms a part of the computational device 102. Typically, the gaming apparatus 100 will include both volatile and non-volatile memory and more than one of each type of memory, with such memories being collectively represented by the memory 103. The instructions to cause the game controller 101 to implement the present invention will be stored in the memory 103.

The gaming apparatus may include hardware meters 104 for the purposes of regulatory compliance and also include an input/output (I/O) interface 105 for communicating with the peripheral devices of the gaming apparatus 100. The input/output interface 105 and/or the peripheral devices may be intelligent devices with their own memory for instructions and data.

In the example shown in FIG. 2, the peripheral devices that communicate with the controller are one or more displays 106, user input devices 107, a card and/or ticket reader 108, a printer 109, a bill acceptor and/or coin input mechanism 110 and a coin output mechanism 111. One or more of the displays 106 may include a touch screen 106A, forming part of the user input devices 107. Additional devices may be included as part of the gaming machine 100, or devices omitted as required for the specific implementation.

In addition, the gaming machine 100 may include a communications interface, for example a network card 112. The network card, may for example, send status information, accounting information or other information to a central controller, server or database and receive data or commands from a the central controller, server or database. One or more of the peripheral devices, for example the card/ticket reader 108 may be able to communicate directly with the network card 112.

The game controller 101 may also include a random number generator 113, which generates a series of random numbers that determine the outcome of a series of random game events played as part of a game on the gaming apparatus 100. As explained in more detail in relation to FIG. 4, the computational device 102 may include two or more controllers or processors, which may be local or remote from each other and the displays 106.

Figure 3:
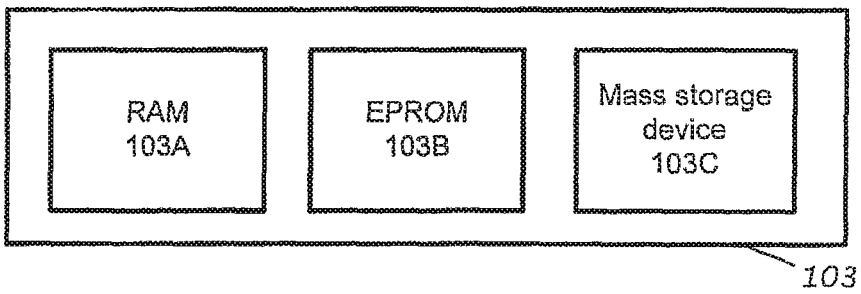
FIG. 3: shows a block diagram of components of the memory of the gaming apparatus represented in FIG. 2.

FIG. 3 shows an exemplary block diagram of the main components of the memory 103. The RAM 103A typically temporarily holds program files for execution by the computational controller 102 and related data. The EPROM 103B may hold be a boot ROM device and/or may contain some system or game related code. The mass storage device 103C is typically used to store game programs, the integrity of which may be verified and/or authenticated by the computational controller 102 using protected code from the EPROM 103B or elsewhere.

Figure 4:
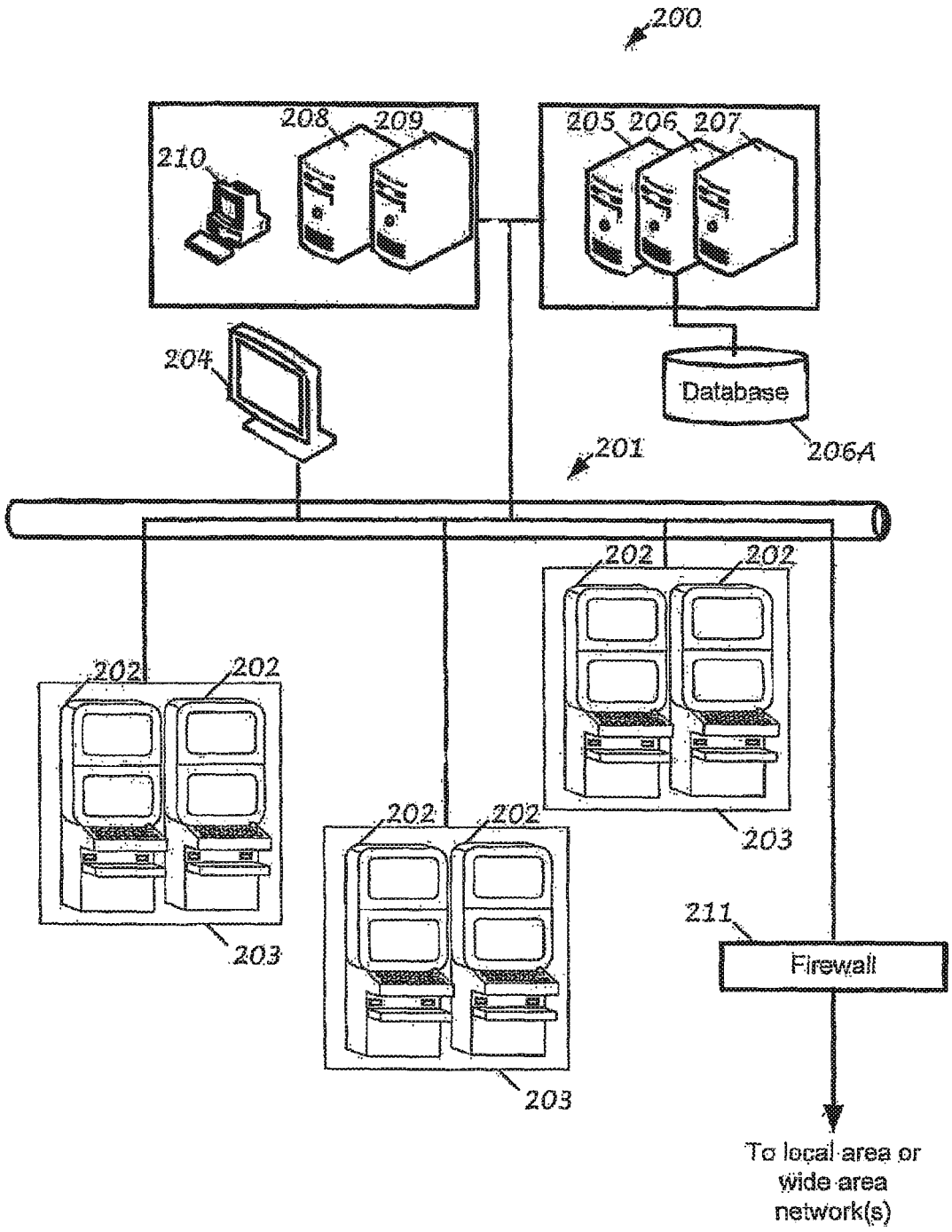
FIG. 4: shows diagrammatically, a network gaming system suitable for implementing certain embodiments of the invention.

FIG. 4 shows a gaming system 200. The gaming system 200 includes a network 201, which for example may be an Ethernet network. Gaming devices 202, shown arranged in three banks 203 of two gaming devices 202 in FIG. 4, are connected to the network 201. The gaming devices 202 may be gaming machines 10, as shown in FIG. 1 or form part or all of another gaming apparatus 100. Single gaming devices 202 and banks 203 containing three or more gaming devices 202 may also be connected to the network 201.

One or more displays 204 may also be connected to the network 201. The displays 204 may, for example, be associated with a bank 203 of gaming devices. The displays 204 may be used to display representations associated with game play on the gaming devices 202, and/or used to display other representations, for example promotional or informational material.

Servers may also be connected to the network 201. For example, a game server 205 may generate game outcomes for games played on the gaming devices 202, a database management server 206 may manage the storage of game programs and associated data for downloading or access by the gaming devices 202 in a database 206A, and a jackpot server 207 may control one or more jackpots associated with the gaming devices 202.

Further servers may be provided to assist in the administration of the gaming system 200, including for example a gaming floor management server 208, and a licensing server 209 to monitor the use of licenses to particular games. An administrator terminal 210 is provided to allow an administrator to run the network 201 and the devices connected to the network.

The servers shown in FIG. 4 may be separate physical devices. Alternatively, a single physical device may run two or more server processes to implement two or more of the servers shown in FIG. 4.

The gaming system 200 may communicate with other gaming systems, other local networks, for example a corporate network and/or a wide area network such as the Internet through a firewall 211.

Figure 5:
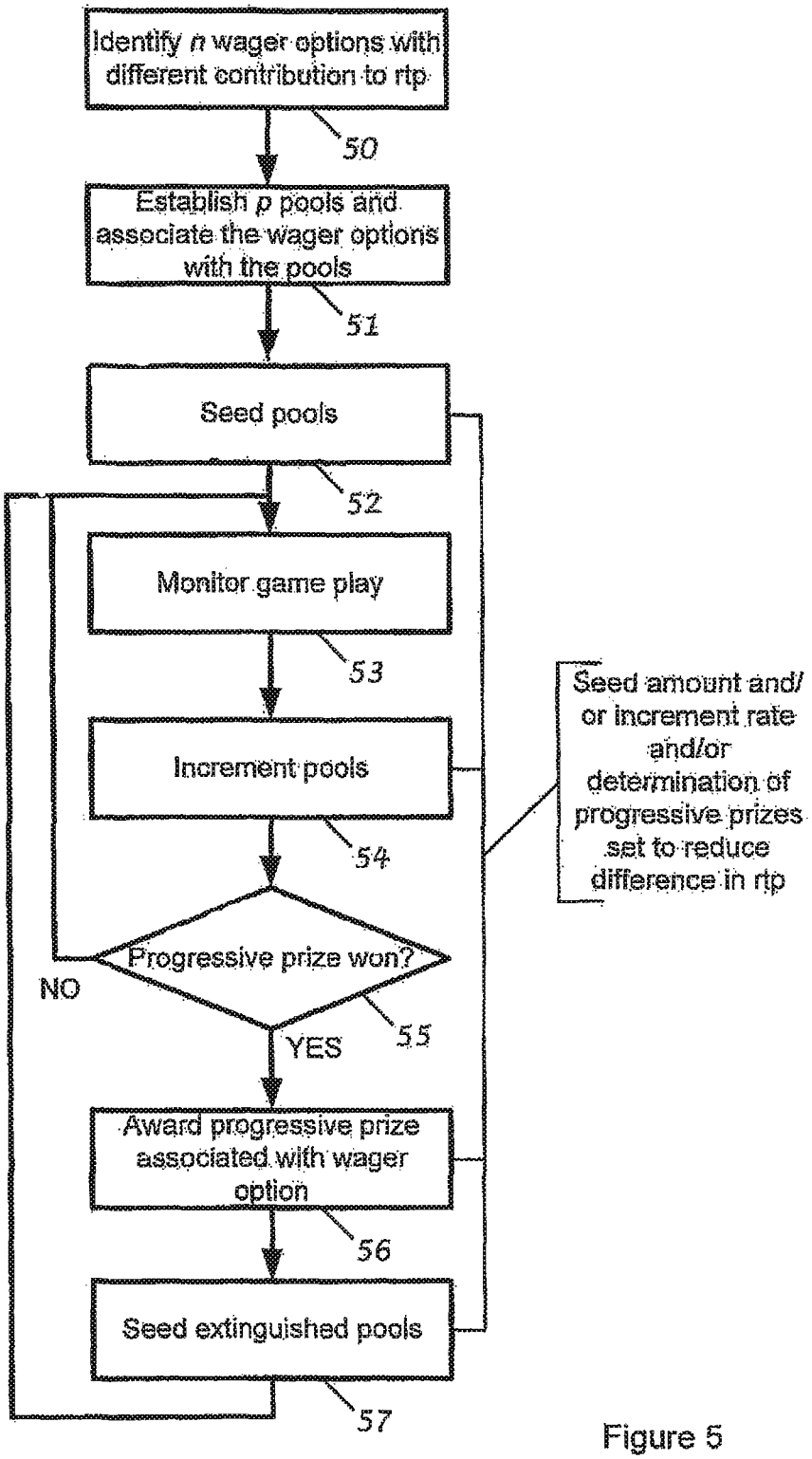
FIG. 5: shows a flow diagram of a process in accordance with an embodiment of the invention.

FIG. 5 shows a process flow diagram of a process performed in accordance with an embodiment of the present invention. The process may be performed within the network gaming system 200, in which the gaming devices 202 may each comprise part or all of a gaming apparatus 100 and the following description assumes this implementation. The process may also be performed by an individual gaming apparatus 100, including a standalone gaming machine 10. Those skilled in the relevant arts will appreciate that the process shown in FIG. 5 (and FIG. 6) will also be able to be implemented by other gaming systems.

FIG. 5 shows a combination of a process to establish a gaming machine or system with progressive prizes and a process to operate the gaming machine or system once it has been established.

In step 50, the number of wagers (n) that may be placed that would result in a different return to player of a game played on a gaming device 202 due to the offering of a single progressive prize are identified. Examples of wager options that have this characteristic include:

In a spinning reel game with unchanging reels and in which the game event that results in the award of the progressive prize is the spinning up of a particular combination of symbols in a pay line that has been purchased by the player, with different options of the wager per line. For example, if the game allowed selection of 1, 2, 3, 5 and 25 pay lines and allowed a wager of 1, 2, 5 or 10 credits per line, there are 4 different wager options corresponding to the wagers of 1, 2, 5, 10 credits per line.

In a spinning reel game with unchanging reels and in which the game event that results in the award of the progressive prize is the spinning up of a particular combination of symbols anywhere in the displayed symbol positions of the reels (otherwise known as scatter pays)—any wager having a distinct wager value. Using the example described herein above, there are 13 different wager options, corresponding to the wagers of 1, 2, 3, 5, 6, 10, 15, 20, 25, 30, 50, 125 and 250 credits.

For games that deal one or more "hands" that are evaluated for a winning outcome, such as card games, bingo games, keno games and dice games, in which the progressive is awarded on the occurrence of a particular outcome that occurs with equal probability regardless of the value of the wager per hand—the different options for the wager per hand.

For games that have a feature game triggered on a particular event, and in which the progressive is awarded on the occurrence of a particular outcome in the feature game, the wager options will need to be determined for the particular game. The wager options will be the wagers that may be placed that result in different expected win rates for the progressive that are not proportional to the difference between the wagers (including where two different wagers of equal value may be made, but which result in different expected win rates for the progressive).

Each wager option may include one or more than one wager. Taking the previously described example of the spinning reel game that pays the progressive on the spinning up of a particular combination in a bought pay line, each wager option includes five different wager values, arising from the different wagers required to play 1, 2, 3, 5 and 25 pay lines.

Where the progressive prizes to be established and maintained are linked to one or more gaming devices 202 that each may provide one or more games and any of the games on any of the gaming devices 202 contribute to and can win the progressive prizes, then the different wager options are the collective set of wager options across all games and all gaming devices 202. One way of identifying the wager options is to determine the expected hit rates for the progressive prize in a particular game play for every possible wager in every playable game and divide the hit rates by the value of the wager. The wager options can then be identified as the wagers associated with each distinct quotient.

Different wagers that have only a slight variation in expected return to player may be grouped together into a single wager option.

In step 51, a plurality of progressive pools are established. The number of progressive pools (p) is determined depending on the requirements for the particular implementation. In the preferred embodiment as presently contemplated there are at least as many pools as there are wager options.

In one embodiment where the maximum bet per line or other outcome is ten credits, then ten progressive pools are established, and one associated with each credit value per line. This embodiment may be particularly applicable where gaming machines with different options for the number of credits per line (the maximum being ten credits), are linked. For example, one of the linked gaming machines may allow the wagering of 1, 3, 5 and 10 credits per line and another one of the linked gaming machines may allow the wagering of 1, 2, 5 and 10 credits per line. If a gaming machine in the link allows more than 10 credits to be wagered per line, or other outcome if the machine plays a different format game, then in this embodiment the number of pools will equal the maximum number of credits that can be wagered on an outcome.

If there is a common divisor other than one of all of the options for wagering per line, then the number of pools may be the maximum number that can be wagered on a line divided by the common divisor. However, for increased flexibility, use of the common divisor one may be used.

Where there a more pools than wager options (ie p>n), then at least one wager option is associated with two or more pools. As explained in more detail below, the association of the pools with wager options may be used to determine the contribution to the pools due to game activity and the way in which the value of the progressive prizes are determined, both of which may reduce differences in expected return to player for the wager options.

The progressive pools may be established and maintained using the jackpot server 207. In a linked progressive system, the jackpot server 207 receives signals relating to the wagers placed on the linked gaming devices 202 (linked in the sense of contributing to the same progressive prizes) and in response increases the progressive prizes. The jackpot server 207 then either reports the values of the progressive prizes to the gaming devices 202 and/or display 204 so that they may be displayed to players of the gaming devices 202 or takes or has control of a display 106 of the gaming devices 202 and/or the display 204 and causes display of the amounts of the progressive prizes.

In step 52, the progressive pools are seeded with a starting value. This starting value may be equal for each pool, or may vary between the pools, depending on the requirements for the particular implementation. Taking into account the expected hit rate for each progressive prize and the corresponding average total amount that would need to be wagered between wins of the progressive prize, the difference in expected return to player may be reduced by increasing the seed values in the pools for the progressive prizes that require a larger average total wager between wins of the progressive prize. The seed value for each of the pools is in one embodiment non-zero.

Once the progressive pools have been established and seeded, monitoring of game play on the gaming devices 202 occurs (step 53). In particular, the wagers placed on the gaming devices 202 are monitored so that the amount that the progressive pools are to be increased as a result of game activities can be determined. Also, game play is monitored for the occurrence of a progressive prize winning event.

In response to game activity, which may be reported by the gaming devices 202, particularly the game controller 101, to the jackpot server 207, the progressive pools are increased in value (step 55). The method of increase of each pool is determined by the requirements for the particular implementation. However, taking into account the expected hit rate for each progressive prize and the corresponding average total amount that would need to be wagered between wins of the progressive prize, the difference in expected return to player may be reduced by increasing the contribution rate to some pools relative to other pools. The overall increase in value of the progressive prizes is a certain percentage of wagers placed during game play of a game.

Monitoring of game play and increasing of the progressive pools continues until it is determined that a progressive prize has been won (step 55). When this occurs, the progressive prize associated with the wager option that was made is determined and awarded (step 56) and then the pools that have been extinguished due to the award are seeded (step 57), ready for continued game play. A third variable that may be used to reduce the difference between the expected return to player of different wager options is the way in which the progressive prize is determined. For example, a progressive prize associated with one wager option may be the sum of several pools, whereas the progressive prize associated with another wager option may be the sum of only one or two pools. In practice, the determination of each of the progressive prizes may be constantly updated during game play by summing the pools allocated to that progressive prize, so that the values of the progressive prizes can be displayed in real time or close to real time.

The process shown in FIG. 5 may be applied to jackpot prizes that are not progressive prizes, with step 54 omitted. The pools are then allocated fixed jackpot prize values when seeded. The value of the pools is selected to reduce differences in the return to player in comparison to if a single jackpot prize was awarded. The value of the fixed jackpot prizes may vary when seeded. For example, while the fixed jackpot prizes do not change once seeded, they may nevertheless have been funded from pools accumulated in the background during the time that the fixed jackpot prizes remain unpaid. When one of the fixed jackpot prizes is won, then the seed value for that jackpot prize may then be set at the accumulated value of the pools associated with that jackpot prize. The association of pools with a jackpot prize may be made in the same manner that the progressives are associated with their pools as described herein.

Similar modifications to implement a jackpot prize awarding system can be made to the process shown in FIG. 6, which is described herein below.

Figure 6:
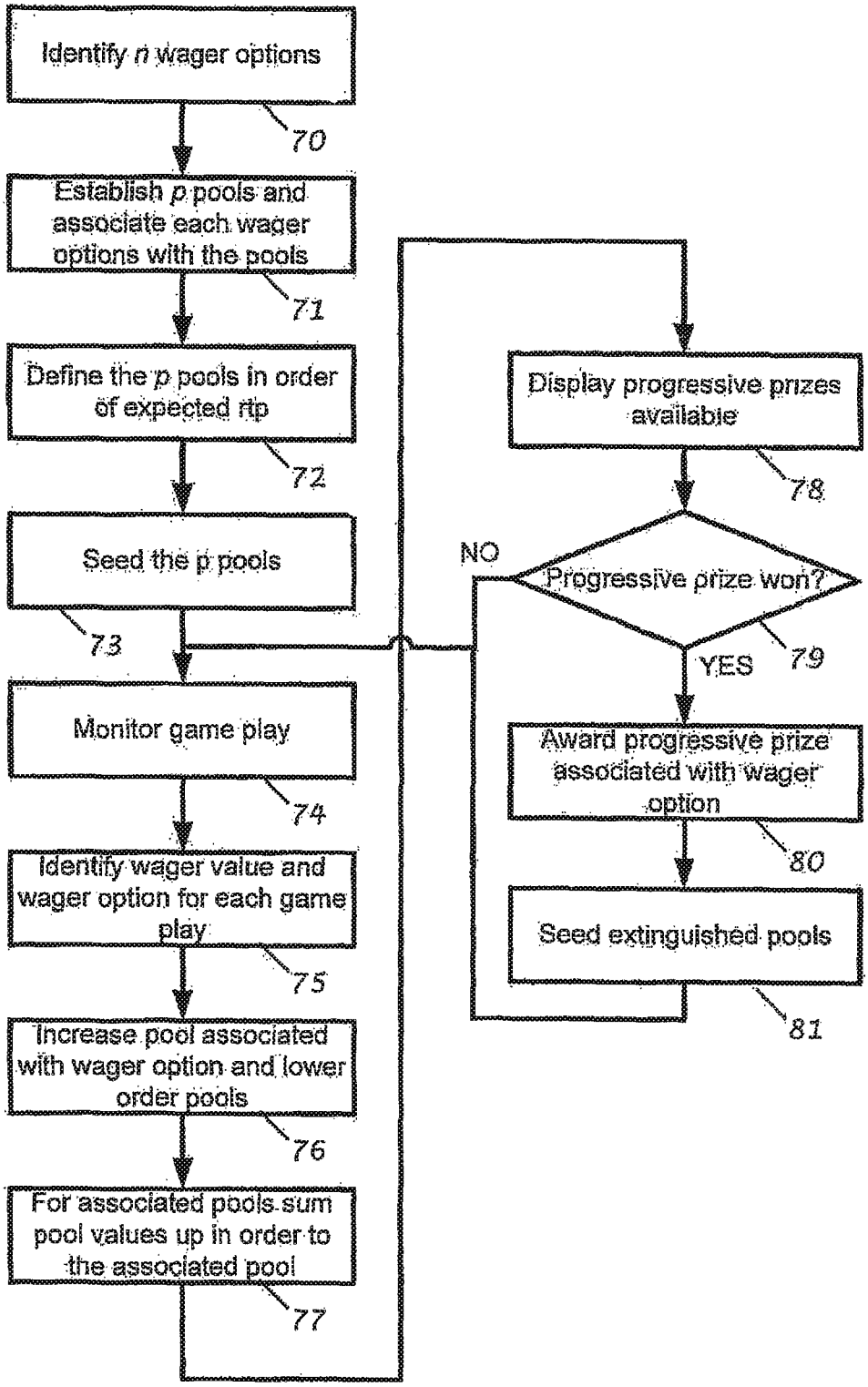
FIG. 6: shows a flow diagram of a process in accordance with an embodiment of the invention.

FIG. 6 shows a combination of a process to establish a gaming machine or system with progressive prizes and a process to operate the gaming machine or system once it has been established, with details of a particular implementation. Steps 70 and 71 are equivalent to steps 50 and 51 respectively in the flow diagram of FIG. 5 and therefore are not explained further.

In step 72 an order of the pools is defined, the order may be in decreasing expected return to player, which for many games would correspond to an order of increasing value of associated wager options. Where there are more pools than wager options, intermediary pools are defined and placed in order depending on the particular implementation. The pools are then seeded (step 73), which is similar to the seeding step described in step 52 of FIG. 5 and game play is monitored (step 74). For each wager that is placed, the wager value is identified and the total contribution to be made to the progressive pools is determined based on the wager value (eg 10% of the wager value). Also, the wager option is identified (step 75).

In step 76 the total contribution to be made to the progressive pools is split between a progressive pool associated with the wager option and each progressive pool associated with wager options with a higher expected return to player and any intermediary pools in the order that may have been provided. The split may be equal, or unequal, depending on the particular implementation.

In step 77, the value of each progressive prize associated with a wager option is determined. In this example, the value of the progressive prize for a wager option is the sum of all the progressive pools that are contributed to when that wager option is made. This information is then communicated by the progressive server 207 to the gaming devices 202 and/or display 204 for display (step 78). Steps 79, 80 and 81 involve the determination of a progressive winning event, payment of the appropriate progressive prize depending on the wager option that was made and seeding of the extinguished pools respectively.

An example of a specific implementation of the process shown in FIG. 6 will now be described in relation to a spinning reel game implemented on a linked gaming device 202, each linked gaming device 202 playing the same game. The spinning reel game is a 5 reel game with 20 defined pay lines and with a choice of 5 different wagers per line. The wagers per line, representing the available wager options, are bet 1, bet 2, bet 3, bet 5, bet 10. A progressive jackpot is won when 5 jackpot symbols appear on a pay line that has been purchased by betting at least 1 credit on that pay line. One credit is 10 cents.

Ten progressive pools have been established numbered one to ten. The first progressive pool is associated with bet 1, the second with bet 2, the third with bet 3, the fifth with bet five and the tenth with bet 10, being in order of decreasing expected return to player. There are five intermediary pools included to control the value of the progressive prizes associated with each wager option. Each progressive pool has a start up of $100 and an increment of 10%.

The jackpot server 207 has accounting meters which, for example, may show that the current values of the progressive pools are:

| Pool # | Value |
|---|---|
| 1 | $128.24 |
| 2 | $126.92 |
| 3 | $133.52 |
| 4 | $143.06 |
| 5 | $113.80 |
| 6 | $125.78 |
| 7 | $135.78 |
| 8 | $111.56 |
| 9 | $135.74 |
| 10 | $127.26 |

The value in the pool 2 is less than the value in the "underlying jackpot" 1. This arises because the number of games played at 2 or more credits per line was less than the number of games played at 1 credit per line since their respective meters were last reset. The jackpots for each wager option are displayed as set out in the following table:

| Wager option | Jackpot value |
|---|---|
| 1 | $128.24 |
| 2 | $255.16 |
| 3 | $388.68 |

-continued

| Wager option | Jackpot value |
|---|---|
| 5 | $645.54 |
| 10 | $1281.66 |

FIG. 7 shows a simplified representation of a screen display that may, for example, be displayed on the display 204 and/or on a screen display of a gaming device 202 that is able to win the jackpots. At the gaming device 202, the jackpot that the player is eligible to win by placing their current wager option may be highlighted, with FIG. 8 showing an example of this, the 3 credit wager option (the player wagering 3 credits per outcome of the game) being highlighted. Alternatively, particularly where all jackpots are displayed on the display 204 and that display is visible from a particular gaming device 202, then the gaming device 202 may only display the jackpot that is eligible to be won with the currently selected wager option or the wager option selected for the previous game play if a current wager option has not yet been selected.

The value displayed for wager option 2 is the sum of the pools for wager options 1 and 2. The value displayed for wager option 3 is the sum of the pools for wager options 1, 2 and 3. The value displayed for wager option 5 is the sum of the pools for wager options 1, 2, 3 and 5, together with intermediary pool 4. The value for wager option 10 is the sum of all the progressive pools.

The player then bets 3 credits on 20 lines, forming a total wager of 60 credits or $6.00. The pool 1 increments by one-third of 10% of $6.00=20 c, pool 2 increments by one-third of 10% of $6.00=20 c, and pool 3 increments by one-third of 10% of $6.00=20 c. Pools 4 to 10 do not change since the multiplier bet was 3. The pools 1 to 10 are now:

| Pool # | Value |
|---|---|
| 1 | $128.44 |
| 2 | $127.12 |
| 3 | $133.72 |
| 4 | $143.06 |
| 5 | $113.80 |
| 6 | $125.78 |
| 7 | $135.78 |
| 8 | $111.56 |
| 9 | $135.74 |
| 10 | $127.26 |

The displayed jackpots are now:

| Wager option | Jackpot value |
|---|---|
| 1 | $128.44 |
| 2 | $255.56 |
| 3 | $389.28 |
| 5 | $646.14 |
| 10 | $1282.26 |

The displayed jackpot for the 1 bet wager option has incremented by 20 c, the displayed jackpot for the 2 bet wager option has incremented by 40 c, and all other displayed jackpots have incremented by 60 c. This increase in increment of the jackpots associated with wager options with lower expected return to player therefore acts to reduce the difference in expected return to player.

The reels spin and stop with 5 jackpot symbols on a pay line. The player is entitled to be paid the jackpot. The player is paid $389.28 and the pools, 1, 2 and 3 are reset to their seed value of $100. The pools are now:

| Pool # | Value |
|---|---|
| 1 | $100 |
| 2 | $100 |
| 3 | $100 |
| 4 | $143.06 |
| 5 | $113.80 |
| 6 | $125.78 |
| 7 | $135.78 |
| 8 | $111.56 |
| 9 | $135.74 |
| 10 | $127.26 |

The displayed jackpots now read:

| Wager option | Jackpot value |
|---|---|
| 1 | $100 |
| 2 | $200 |
| 3 | $300 |
| 5 | $556.86 |
| 10 | $1192.98 |

The pools described herein are incremented based on game play of a game. The independent variable used to increment the pools may be the coin-in or turnover on the gaming machine(s). However, other independent variables may be used, for example, particular game outcomes.

While the foregoing description has been provided by way of example of certain embodiments of the present invention as presently contemplated, which utilise gaming apparatus and machines, those skilled in the relevant arts will appreciate that the present invention also may have application to internet gaming and/or have application to gaming over a telecommunications network, where handsets are used to display game outcomes and receive player inputs.

Where in the foregoing description reference has been made to integers having known equivalents, then those equivalents are hereby incorporated herein as if individually set forth.

Those skilled in the relevant arts will appreciate that modifications and additions to the embodiments of the present invention may be made without departing from the scope of the present invention.

It will be understood that the invention disclosed and defined in this specification extends to all alternative combinations of two or more of the individual features mentioned or evident from the text or drawings. All of these different combinations constitute various alternative aspects of the invention.

The invention claimed is:

1. A gaming system comprising at least one gaming machine, said at least one gaming machine having a credit input mechanism configured to receive a physical item associated with a monetary value for establishing a credit balance, the credit balance being increasable and decreasable based at least on wagering activity, and a player interface configured to receive one of a plurality of wager options, providing a game in which a plurality of symbols are presented on a display and if a winning combination occurs in the presented plurality of symbols, the gaming machine awards an award, the gaming system comprising:

an electronic processing system comprising at least one jackpot controller configured to, in accord with having established the credit balance via the credit input mechanism of the at least one gaming machine receiving the physical item,:

maintain a plurality of jackpot prizes that can be won through play of said at least one gaming machine, said jackpot prizes being funded by respective ones of a plurality of progressive pools dependent on said play and the wager option received at the at least one gaming machine, the wager options comprising n distinct wager options for which the probability of winning a jackpot prize is different, resulting in differences in a return-to-player between the wager options, and associate each wager option with one of the jackpot prizes, each of said distinct wager options being associated with at least one progressive pool;

monitor for an occurrence of a jackpot winning outcome, and on the occurrence of the jackpot winning outcome, associate the occurrence of the jackpot winning outcome with the received one of said wager options and pay the jackpot prize associated with the received one of said wager options; and determine, for each of the jackpot prizes, a fixed jackpot amount that cannot be varied once initially seeded so as to reduce the differences in the return-to-player between the wager options.

2. The gaming system of claim 1, comprising a plurality of gaming machines, each of which contribute to the progressive prizes and win one of the progressive prizes on the occurrence of a progressive winning outcome.

3. A method of providing a game on a gaming system having a display, said at least one gaming system a credit input mechanism configured to receive a physical item associated with a monetary value for establishing a credit balance, the credit balance being increasable and decreasable based at least on wagering activity, and a player interface configured to play a game, and to receive one of a plurality of wager options, the plurality of wager options comprising n distinct wager options, the method comprising:

establishing a credit balance via said credit input mechanism receiving the physical item;

in accord with having established the credit balance via the credit input mechanism receiving the physical item, maintaining a plurality of winnable jackpot prizes;

presenting via the display a game play of the game at least one symbol to form at least one outcome from a plurality of outcomes comprising a jackpot winning outcome;

funding the plurality of winnable jackpot prizes through respective ones of a plurality of progressive pools dependent on said game play of the game;

associating each of said distinct wager options with at least one progressive pool;

awarding one of the plurality of jackpot prizes on an occurrence of the jackpot winning outcome during the game play of the game; and receiving one of the plurality of wager options on the formed at least one outcome, wherein a probability of an occurrence of the jackpot winning outcome per unit wager is different, wherein n is at least two and each of the n distinct wager options is associated with one of the winnable jackpot prizes, when the jackpot winning outcome occurs in a game play, awarding the jackpot prize associated with the wager option made in the game play; and determining, for each of the jackpot prizes, a fixed jackpot amount that cannot be varied once initially seeded so as to reduce differences in a return-to-player between the wager options.

4. The method of claim 3, including forming a plurality of said outcomes and allowing the player to select both the number of outcomes on which to stake a wager and the amount of the wager that is staked on each of the selected number of outcomes, so as to form a total wager value representing the product of the selected number of outcomes and the wager staked per outcome, wherein at least one of the wager options can be made by staking any one of a plurality of different total wager values.

5. A gaming system comprising at least one gaming machine, said at least one gaming machine having a credit input mechanism configured to receive a physical item associated with a monetary value for establishing a credit balance, the credit balance being increasable and decreasable based at least on wagering activity, and a player interface configured to receive one of a plurality of wager options, providing a game in which a plurality of symbols are presented on a display and if a winning combination occurs in the presented plurality of symbols, the gaming machine awards an award, the gaming system comprising:

an electronic processing system comprising at least one jackpot controller configured to, in accord with having established the credit balance via the credit input mechanism of the at least one gaming machine receiving the physical item,:

maintain a plurality of jackpot prizes that can be won through play of said at least one gaming machine, the jackpot prizes being funded by respective ones of a plurality of progressive pools dependent on said play and the wager option received at the gaming machine, the wager options comprising n distinct wager options for which the probability of winning a jackpot prize is different, resulting in differences in a return-to-player between the wager options, and associate each wager option with one of the jackpot prizes, each of said distinct wager options being associated with at least one progressive pool;

monitor for an occurrence of a jackpot winning outcome, and on the occurrence of the jackpot winning outcome, associate the occurrence of the jackpot winning outcome with the received one of said wager options and pay the jackpot prize associated with the wager option; and assigning values that cannot be varied once initially seeded to the jackpot prizes so as to reduce the differences in the return-to-player between the wager options.

6. The gaming system of claim 5, wherein at least one of the wager options is associated with a plurality of different wager values.

* * * * *